United States Patent [19]

Carpenter

[11] 4,325,152

[45] Apr. 20, 1982

[54] FLOTATION MATTRESS

[76] Inventor: Michael Carpenter, 227 Easton S., Laurel, Md. 20810

[21] Appl. No.: 16,175

[22] Filed: Feb. 28, 1979

[51] Int. Cl.[3] ..... A47C 27/08

[52] U.S. Cl. ..... 5/451

[58] Field of Search ..... 5/450, 451, 452, 455, 5/457, 458

[56] References Cited

U.S. PATENT DOCUMENTS

| | | | |
|---|---|---|---|
| 4,168,555 | 9/1979 | Benjamin | 5/452 |
| 4,172,301 | 10/1979 | Everard et al. | 5/456 |
| 4,192,031 | 3/1980 | Fogel | 5/451 |
| 4,204,289 | 5/1980 | Fogel | 5/451 |

*Primary Examiner*—Alexander Grosz

*Attorney, Agent, or Firm*—Bernard, Rothwell & Brown

[57] ABSTRACT

A flotation mattress and a method for making same. The mattress is comprised of flexible, liquid-impermeable material sealed to form a liquid impermeable envelope. One or more damping chambers are disposed within the mattress which damping chambers have means for liquid communication between the portion of the liquid within the interior of the chambers and liquid around the chambers. The damping chambers impede wave motion generated by an imposed pressure on the mattress by operating as physical impediments to wave propagation and, additionally, by providing countervailing liquid flow from the interior of said chambers into the surrounding liquid body within the envelope.

19 Claims, 4 Drawing Figures

FLOTATION MATTRESS

BACKGROUND OF THE INVENTION

This invention is related to flotation mattresses and is more particularly concerned with providing damping means to inhibit wave motion in flotation mattresses that contain a liquid. Liquid-containing flotation mattresses have gained wide acceptance and popularity as bedroom furnishings. Conventional flotation mattresses have been subject to criticism from the consuming public for three main reasons, i.e., excessive weight of the mattress in the liquid-filled condition for use, leakage of liquid from the mattress, and wave propagation within the flotation liquid when a pressure is exerted upon the mattress. The weight problem has been addressed in the prior art by employing liquid displacement aids within the mattress to decrease the amount of liquid necessary to attain the liquid filled condition for use, e.g., see Warner, U.S. Pat. No. 3,748,669. The leakage problem has been substantially eliminated by the utilization of improved sealing techniques, e.g., Pennington, U.S. Pat. No. 3,876,486; Mollura, U.S. Pat. No. 3,753,819; Lambert, et al. U.S. Pat. No. 3,869,327; and modifications in the construction of the mattresses per se, e.g., Benjamin, U.S. Pat. No. 4,100,634; Lambert, U.S. Pat. No. 4,107,799; Mollura, U.S. Pat. No. 3,825,172. The other problem, wave propagation and consequent wave motion within the liquid, has remained unsolved in a satisfactory manner despite the wide recognition of the problem within the industry and the commercial realization that the problem impedes acceptance of flotation mattresses by a wide segment of prospective purchasers.

Prior attempts to resolve the wave motion problem have entailed the use of air pocket buffers on the upper and lower periphery of the mattress, e.g., Callenance, U.S. Pat. No. 4,080,676 and Phillips, U.S. Pat. No. 4,101,995; sheet baffles affixed to the upper and lower sheets of the mattress, e.g., LaBianco, U.S. Pat. No. 3,840,921, and weighted sheet baffles affixed to the upper sheet of the mattress, e.g., Carson Jr., U.S. Pat. No. 3,736,604. None of the foregoing attempts to resolve the wave motion phenomenon has achieved success in damping the wave motion quickly enough to avoid discomfort to the user.

SUMMARY OF THE INVENTION

Accordingly, it is an object of the present invention to provide a flotation mattress which incorporates means to inhibit or dampen wave motion generated by the imposition of pressure on the flotation mattress containing a liquid.

Another object of the invention is to provide a method for the manufacture of a flotation mattress incorporating the wave inhibiting or dampening means of the instant invention. A further object of the invention is to provide a means to generate forces within the liquid which inhibit or dampen wave motion generated by the imposition of localized pressure on the flotation mattress.

Briefly, the invention comprises a flotation mattress comprised of liquid-impermeable, flexible sheet material which is sealed to form a liquid-impermeable envelope. One or more damping chambers are disposed within the envelope. The damping chambers are provided with means to provide liquid communication between the liquid in the interior of the damping chamber and the other liquid in the envelope surrounding the chambers. The damping chambers physically impede wave motion and provide countervailing liquid motion within the envelope. When the envelope is deformed by an imposed pressure, the damping chambers are deformed and liquid within one or more of the damping chambers is directed into the main body of liquid within the envelope.

Further objects, advantages, and features of the invention will be apparent in the arrangement and construction of the constituent parts in detail as set forth in the following specification taken together with the accompanying drawings.

DETAILED DESCRIPTION OF THE PREFERRED EMBODIMENT

Figure 1:
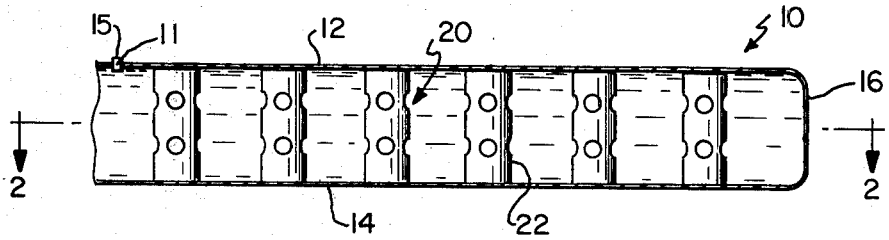
FIG. 1 is a cross-sectional, side view of the preferred embodiment of the mattress of the invention taken along line 1—1 of FIG. 2.

Referring to FIG. 1 there is shown a preferred form of flotation mattress of the invention indicated at 10 having an upper sheet section 12 and a lower sheet section 14. The mattress has a gusset or side panel 16 extending around the periphery of the mattress to which sheets 12 and 14 are sealed by conventional means well known in the art to form a liquid-impermeable envelope. Sheets 12 and 14 and gusset panel 16 are generally fabricated from synthetic resinous sheet material, such as polyvinyl chloride, and the sheet material has a sufficient thickness, e.g. about 10–30 mils, and strength to hold the liquid in the mattress during use.

Figure 3:
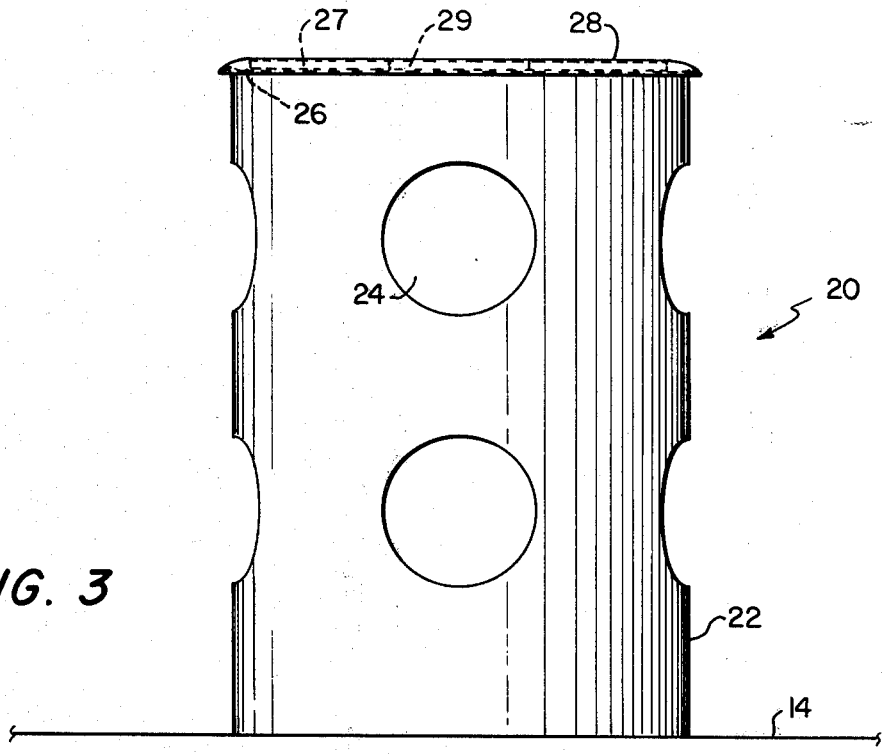
FIG. 3 is a side, elevational view of a damping chamber of the mattress.

Disposed within the mattress 10 are a plurality of damping chambers indicated generally at 20. As shown in greater detail in FIG. 3 the damping chambers 20 of the preferred embodiment have side walls 22. The side walls are made of flexible material that may be the same as that used to form the upper and lower sheet sections 12 and 14. The walls 22 of the damping chambers have a plurality of openings 24. The openings 24 may be in the form of a slit or a cut-out of material in the side wall 22. Most advantageously the openings 24 are a cut-out of material e.g. a hole in the side wall to allow an unencumbered flow of liquid from the liquid contained in the interior of the chambers and the liquid surrounding the chambers. In the embodiment in the drawings the walls 22 of the damping chambers 20 define a cylinder, e.g. a right, circular cylinder, of for instance, approximately 6 inches in diameter and of about 9 to 9½ inches in height. Generally, the top of the cylinders contact or terminate with about ¼ to 1 inch of the adjacent top or bottom sheet of the mattress. The openings 24 in the walls 22 are, preferably, circular holes having a diameter of, for example, approximately 2 inches. In the preferred embodiment the walls 22 of each damping chamber have 8 such openings 24. The openings 24 can be arranged in the manner depicted in FIG. 3, with vertically, positioned sets of openings 24 being disposed at about 90° from an adjacent set of openings on cylindrical wall 22, the openings being vertically-spaced by approximately $2\frac{1}{2}$ inches.

In the preferred embodiment of the invention the surface area of the openings 24 in the cylindrical wall 22 should comprise about 15 to 45 percent, preferably about 25 to 35 percent, of the surface area of the cylindrical wall 22. If the openings in the damping chambers comprise less than say about 15 percent of the total surface area of the side of the damping chamber, the liquid will not flow out of the chamber adequately and a hard, uncomfortable sensation will be felt by the user while moving on the mattress. Conversely, if the surface area of the openings in the damping chambers is too large a proportion of the total surface area of the side of the damping chamber, say more than about 45 percent, the generation of countervailing liquid flow from the interior of the damping chambers into the liquid within the envelope is diminished too much.

In the preferred embodiment the openings in the damping chamber are symetrically distributed on the side wall 22 of the damping chamber. Though a symetrical distribution is preferred, such that 50% of the surface area of the openings on the surface of the wall 22 are on opposing halves of the walls, generally about 25 to 75% of the surface area of the openings should be on the opposing halves of the wall 22.

Figure 2:
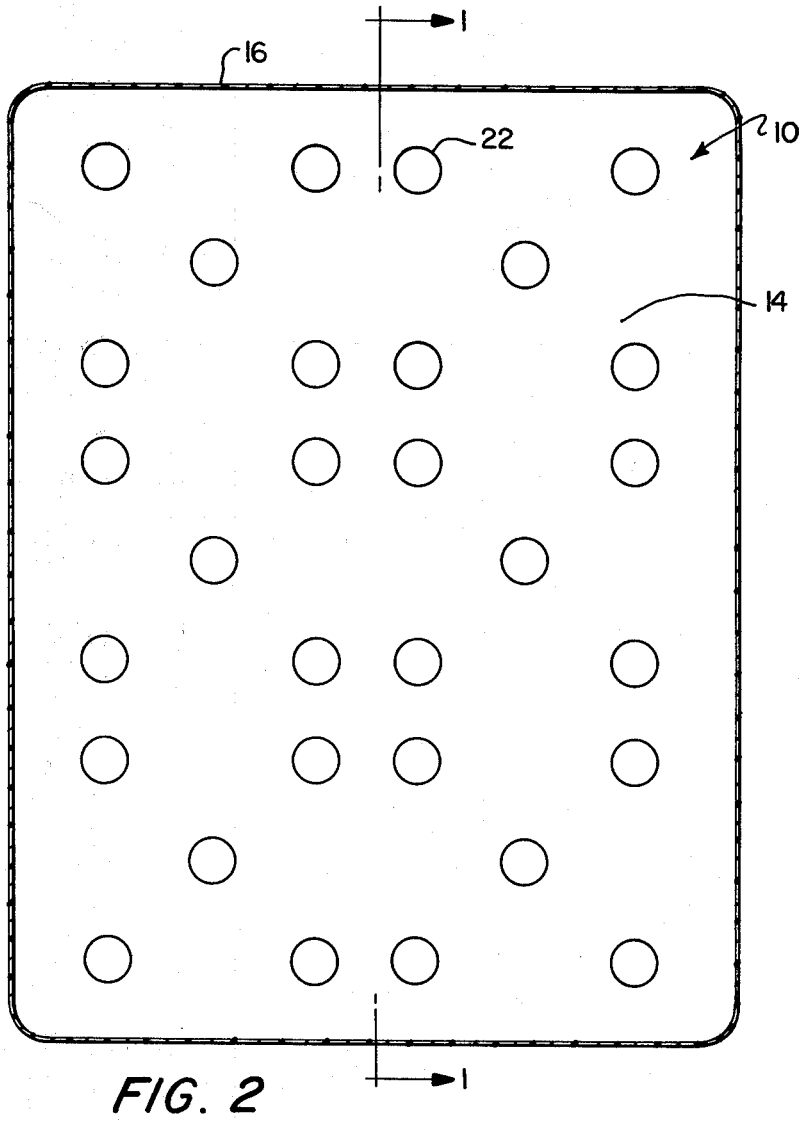
FIG. 2 is a cross-sectional, plan view of the preferred embodiment of the mattress of the invention taken along line 2—2 of FIG. 1.

In the embodiment depicted in FIG. 2, approximately thirty damping chambers 20 are positioned in the mattress envelope. It is preferred that the damping chambers 20 be substantially symetrically disposed within the mattress envelope. FIG. 2 presents one such symetrical arrangement of the damping chambers 20.

In the preferred embodiment, the damping chambers 20 in their finished configuration are fixedly attached to sheet 14. The upper end section of each damping chamber 20 is composed of two layers 26 and 28. The layers 26 and 28 may be formed of the same material used to form the upper and lower sheets 12 and 14 or other like material which is capable of being sealed to walls 22. Spaced between the layers 26 and 28 is a non-water absorbent disk 27 of buoyant material e.g., styrofoam of approximately $\frac{1}{4}$ inch in thickness. The layers 26 and 27 and disk 28 have conforming openings 29, preferably positioned in their central portion and in the preferred embodiment being a circular hole of approximately 2 to $2\frac{1}{4}$ inches in diameter. Opening 29 allows the escape of entrained air from damping chamber 20 when the flotation mattress 10 is being filled with liquid, through opening 15 in sheet 12. When the flotation mattress is filled with liquid, the damping chambers 20 under the buoyant influence of disk 27 will assume the more or less erect position depicted in FIG. 1. The top of the damping chambers 20 when the flotation mattress is in the liquid filled condition will contact the interior side of sheet 12 or will be in close proximate relationship. After filling the mattress with liquid, opening 15 can be closed by plug 11.

The chambers 20 of the preferred embodiment of the invention presented in FIG. 1 are attached to only the lower sheet section 14. Therefore, the chambers remain in a substantially erect configuration under the buoyant effect of disk 27, thereby presenting physical impediment to wave motion generated when a pressure is imposed upon the flotation mattress 10 while not being subject to stresses imposed if the ends of the damping chambers 20 were affixed to both interior surfaces of sheets 12 and 14. The subject stresses could cause tearaway of the affixed chambers during use.

As will be appreciated by those skilled in the art a like operable orientation of the damping chambers 20 could be achieved by affixing the wall of the chambers to upper sheet 12 and affixing weights to the lower end section of the damping chamber. Thus the damping chamber could be retained in an essentially vertical orientation.

Additionally, a like operable orientation of the damping chambers 20 could be achieved by affixing a buoyant disk to the upper end section of the damping chamber and weights to the lower end section of the damping chamber. It may be desirable to prevent migration of the damping chambers within the mattress in this embodiment by providing damping chambers 20 which have connecting ribs (not shown) as a means to fix the position of the damping chambers 20 within the mattress.

In addition to the physical impediment to wave motion provided by the placement of damping chambers 20 within the flotation mattress, the liquid communication between the liquid in the interior of the damping chambers 20 and the liquid disposed there around within the flotation mattress envelope through openings 24 additionally serves to damp wave motion generated by the imposition of a pressure on the mattress. When the sheet 12 is displaced downwardly under an imposed pressure the interior surface of sheet 12 will contact and deform damping chamber 20. As damping chamber 20 is deformed the liquid in the chamber will be expelled radially relative to the walls 22 of the damping chamber 20 creating currents of liquid flow within the flotation mattress. The currents of liquid so generated will operate to impede wave motion within the mattress generated by the initial imposition of pressure on sheet 12. Any number of damping chamber configurations can be used to attain the damping effects of the instant invention.

Other such configurations could include rectangular or spherical damping chambers 20. The damping chambers 20 generally contain a minor amount of the total liquid contained in the filled mattress envelope when the mattress is in a static non-pressure imposed condition depicted in FIG. 1. For example as depicted in FIG. 2 of the preferred embodiment the chambers contain approximately 15 to 25 percent of the total liquid surrounding the chambers in the filled mattress envelope.

The buoyant disk 27 of the preferred embodiment is made of a pliant or soft buoyant material to prevent discomfort to the user when sheet 12 is displaced downwardly and contacts the upper portion of damping chamber 20.

Figure 4:
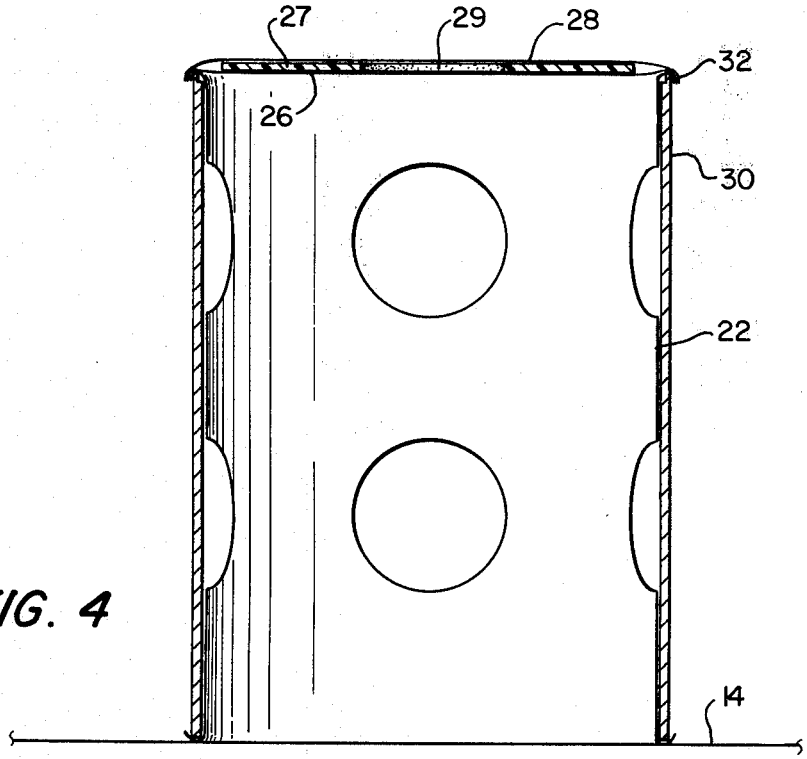
FIG. 4 is a side view of a damping chamber as placed on a mandrel during the sealing operation.

As presented in FIG. 4, the lower ends of the walls 22 of damping chambers 20 may be fixedly sealed to sheet 14 and layers 26 and 28 in a single manufacturing operation. The use of one manufacturing operation to seal the damping chambers 20 presents a simple and therefore economical means to manufacture the flotation mattress 10 having damping chambers 20 disposed therein. As presented in FIG. 4, a metal mandrel 30 is provided having approximately the same interior dimensions as the exterior dimensions of walls 22 of damping chamber 20. The wall portion 22 of the damping chamber 20 is placed within the mandrel 30, and the edges of the opposing ends of walls 22 are pulled over the opposing edges of mandrel 30. A number of mandrels 30 are then positioned on sheet 14 in the pattern presented in FIG. 2. Layers 26 and 28 with buoyant disk 27 disposed between the layers 26 and 28 are then placed over the upper end of the mandrel 30 opposite to the end contacting sheet 14. The layers 26 and 28 are of greater size than the mandrel 30 to allow overlap of the edges of the layers 26 and 28 in relation to the edges of mandrel 30. The disk 27 of buoyant non-water absorbent material is smaller than the diameter of the mandrel 30, e.g., about ½ to 1 inch smaller in diameter. A radio-frequency energy sealer, e.g., a solid aluminum plate (not shown) is then placed over the mandrels 30, and a radio-frequency current is applied to the upper and lower sections of mandrel 30 to seal the lower section of wall portion 22 to sheet 14 and seal layers 26 and 28 to the upper section of wall portion 22. It will be appreciated that mandrel 30 may be fabricated from any material which is capable of use in radio frequency sealing, e.g. aluminum or brass. The upper periphery of mandrel 30 may be provided with a raised sharp periphery edge 32 to partially perforate the excess material of layers 26 and 28 during the sealing operation. The radio-frequency sealing apparatus (not shown) does apply some moderate pressure, of for instance approximately 80–100 psi, to the upper portion of mandrel 30 to effect sealing and partial perforation of the excess material of layers 26 and 28. The raised edge 32 on the upper portion of mandrel 30 can be approximately 22 thousandths of an inch in height. The excess material of layers 26 and 28 can be removed by tearing the excess material along the cut indentations imparted by raised edge 32. After completion of the heat-sealing step, the sheet 14 with the damping chamber 20 affixed thereto is sealed to gusset panels 16 and upper sheet 12 by conventional means to form a fluid impermeable envelope.

While there has been shown and described what is considered to be preferred embodiments of the present invention, it will be obvious to those skilled in the art that various changes and modifications may be made therein without departing from the invention.

I claim:

1. A flotation mattress comprised of flexible sheet material which forms a liquid-impermeable envelope having two opposing interior surfaces, a plurality of flexible damping chambers disposed within said envelope, said chambers having at least one opening to provide liquid communication between the liquid within the interior portion of said chambers and the liquid in said envelope surounding said chambers; each said chamber being comprised of a wall portion and upper and lower end portions, only one said end portion being fixedly attached to one of said opposing interior surfaces of said envelope and the other said end portion being substantially free to move relative to the other opposing interior surface of said envelope.

2. The flotation mattress of claim 1 wherein the said envelope is formed of flexible upper and lower sheets sealed to a side gusset panel to form the said liquid-impermeable envelope.

3. The flotation mattress of claim 1 wherein the said chambers are comprised of a wall portion and upper and lower end portions, said chambers having means to position the said chambers in a substantially erect position when said mattress is filled with said liquid.

4. The flotation mattress of claim 3 wherein said means to position said chambers is comprised of a buoyant material affixed to a portion of said chamber opposed to said fixedly attached portion of said chamber.

5. The flotation mattress of claims 1, 2 or 3 wherein said chambers contain about 15 to 25 percent of the total liquid in the said envelope in the filled, static, non-pressure imposed condition.

6. The flotation mattress of claims 1, 2 or 3 wherein said wall portion and said upper and lower end portions of said chambers define a right, circular cylinder.

7. The flotation mattress of claims 1, 2 or 3 wherein the portion of said chamber opposed to said fixedly attached portion of said chamber has at least one hole.

8. A flotation mattress comprised of a flexible sheet material which forms a liquid-impermeable envelope having two opposing interior surfaces, a plurality of flexible damping chambers disposed within said envelope, said chambers having at least one opening to provide liquid communication between the liquid within the interior portions of said chambers and the liquid in said envelope surrounding said chambers; each said chamber being comprised of a wall portion and upper and lower end portions, only one said end portion being fixedly attached to one of said opposing interior surfaces of said envelope and the other said end portion being substantially free to move relative to the other opposing interior surface of said envelope; the surface area of said at least one opening comprising about 15 to 45 percent of the total surface area of each said chamber.

9. The flotation mattress of claim 8 wherein the surface area of said at least one opening comprises about 25 to 35 percent of the total surface area of each said chamber.

10. The flotation mattress of claim 8 wherein the said envelope is formed of flexible upper and lower sheets sealed to a side gusset panel to form the said liquid-impermeable envelope.

11. The flotation mattress of claim 8 wherein the upper and lower end portions of said chambers have means to position the said wall portion in a substantially erect position when said mattress is filled with said liquid.

12. The flotation mattress of claim 11, wherein said chambers contain about 15 to 25 percent of the total liquid in the said envelope in the filled, static, non-pressure imposed condition.

13. The flotation mattress of claim 11 wherein said wall portion and said upper and lower end portions of said chambers define a right, circular cylinder.

14. The flotation mattress of claim 11 wherein said means to position said chambers is comprised of a buoyant material affixed to said upper end portion of said chamber.

15. The flotation mattress of claim 11 wherein the upper end portion of each said chamber has at least one hole.

16. The flotation mattress of claim 11 wherein the said at least one opening in each said chamber is a circular, approximately 2 inch diameter, opening.

17. The flotation mattress of claim 16, wherein the said at least one opening is comprised of a plurality of sets of vertically positioned openings disposed on the said wall portion of said damping chamber each said set of vertically positioned openings being at approximately 90° from an adjacent set of said openings.

18. A method for inhibiting wave motion in a flotation mattress comprising flexible sheet material which forms a liquid impermeable envelope having two opposing interior surfaces which method comprises providing at least one damping chamber disposed within said envelope, each said chamber being comprised of a wall portion and upper and lower end portions only, one said end portion being fixedly attached to one of said opposing interior surfaces of said envelope and the other said end being substantially free to move relative to the other opposing interior surface of said envelope, said chambers having at least one opening to provide liquid communication between the liquid within the interior of said chambers, and the liquid within said envelope, the surface area of said at least one opening comprising 15% to 45% of the total surface area of each said chamber; wherein upon deformation of the envelope under an imposed pressure the damping chambers are deformed and the liquid disposed within said chambers is directed outwardly from said chambers through said at least one opening into said liquid surrounding said chambers.

19. The method of claim 18 wherein the surface area of said at least one opening comprises 25 to 35 percent of the total surface area of each such chamber.

* * * * *

UNITED STATES PATENT AND TRADEMARK OFFICE

CERTIFICATE OF CORRECTION

PATENT NO. : 4,325,152

DATED : April 20, 1982

INVENTOR(S) : Michael Carpenter

It is certified that error appears in the above-identified patent and that said Letters Patent is hereby corrected as shown below:

Column 1, line 56, "dampening" should be --damping--.

Column 2, line 61, "with" should be --within--.

Column 5, line 49, claim 1, "surounding" should be --surrounding--.

Signed and Sealed this

*Seventh* Day of *September 1982*

[SEAL]

*Attest:*

GERALD J. MOSSINGHOFF

*Attesting Officer*

*Commissioner of Patents and Trademarks*